United States Patent [19]

Hoshino

[11] Patent Number: 4,905,565

[45] Date of Patent: Mar. 6, 1990

[54] HIGH HAT STAND

[75] Inventor: Yoshihiro Hoshino, Nagoya, Japan

[73] Assignee: Hoshino Gakki Co., Ltd., Japan

[21] Appl. No.: 360,323

[22] Filed: Jun. 2, 1989

[30] Foreign Application Priority Data

Sep. 4, 1988 [JP] Japan ..... 63-221984

[51] Int. Cl.[4] ..... G10D 13/00

[52] U.S. Cl. ..... 84/422.3

[58] Field of Search ..... 84/422.1, 422.3

[56] References Cited

U.S. PATENT DOCUMENTS

| | | | |
|---|---|---|---|
| 3,797,356 | 3/1974 | Duffy et al. | 84/422.1 |
| 4,145,951 | 3/1979 | Kobayashi | 84/422.3 |
| 4,449,440 | 5/1984 | Hoshino | 84/422.3 |
| 4,817,490 | 4/1989 | Cahill | 84/422.3 |
| 4,819,536 | 4/1989 | Lombardi | 84/422.1 |

*Primary Examiner*—Lawrence R. Franklin

*Attorney, Agent, or Firm*—Ostrolenk, Faber, Gerb & Soffen

[57] ABSTRACT

A high hat stand for a pair of cymbals, including a support for a stationary cymbal and a vertically slidable coaxial operating rod for a cooperating movable cymbal. A spring returns the movable cymbal off the stationary one. A foot pedal operates the movable cymbal against the stationary cymbal. The connection between the foot pedal and the movable cymbal comprises a pair of rotary members, one connected to and movable by the foot pedal and the other connected to move the operating rod for the movable cymbal. The rotary members are attached to the same axis to rotate together. From the axis of rotation to its point of operative connection, the lever arm of the rotary member connected to the foot pedal is longer than the lever arm of the rotary member connected to the operating rod of the movable cymbal. Each rotary member is defined either by a lever or a sprocket. An additional swingable arm may be connected to the axis of the rotary members to enable the axis to swing with respect to the movable cymbal operating rod when the rotary member connected to the cymbal operating rod is a lever. This reduces the effect of lateral bias on the rod due to swinging of the lever as it rotates around its axis.

21 Claims, 13 Drawing Sheets

HIGH HAT STAND

BACKGROUND OF THE INVENTION

The present invention relates to a high hat stand including a cymbal operating rod that is moved up and down by a foot pedal.

The high hat stand has a lower fixed cymbal and a cooperating upper movable cymbal above the lower cymbal. The upper movable cymbal is moved up away from the lower cymbal and down to engage the lower cymbal by up-and-down movement of an operating rod for the cymbal which moves up and down in response to movement of a connected foot pedal at the lower part of the stand. The upper cymbal is normally urged away from the lower cymbal by a spring on or near to and connected to the operating rod. The performer presses on the pedal to overcome the spring force and move the cymbals together. In a high hat stand, high speed and accuracy of the action of the movable cymbal, i.e. highly responsive action, is required of the movable cymbal for the performer's musical performance to be accurately expressed. For the mechanism, this responsiveness arises from the pedal being stepped on lightly and being restored quickly to the original cymbals separated position. Because the operating rod is given a continuous upward bias by the spring, it is normally necessary to weaken the spring in order for the pedal to be stepped down lightly. But, in order for the pedal to be restored quickly, it is necessary for the spring to be stronger. These contradictory requirements are met by the present invention. Further, a mechanism is required that permits a delicate opening and closing of the movable cymbal and/or a mechanism is needed enabling the cymbals which are tightly closed together to slightly open or close by a delicate pedal operation.

In known high hat stands, an example of which is seen in FIG. 14 hereof, the cymbal operating rod 200 is directly connected with the pedal 210. This causes the operating force of the pedal 210 to be the same operating force acting on the cymbal operating rod 200. Moreover, a force, which is the same as the spring pressure of the spring device 205, is required for stepping on the pedal 210. In FIG. 14, a chain 207 connects a connector 206 for the spring of the spring device and the operating rod with the pedal 210.

Known direct connection structures do not improve upon the satisfaction of the basic requirements as they are merely cosmetic and are designed to change the feel of performance by the difference in the size of resistance or the strength of the spring.

SUMMARY OF THE INVENTION

Through experiments, the present inventor noted that the aforementioned requirements cannot be met as long as the pedal and the cymbal operating rod are directly connected together. Instead, it was found that the pedal and the cymbal operating rod should be connected through a rotary member that utilizes a differential lever operation principle.

The primary object of the invention is to provide a high hat stand which is very responsive.

Another object is to provide such a stand in which the pedal can be stepped on with a lighter force.

A further object is to provide such a stand in which restoration of the foot pedal is faster.

Yet another object is to provide such a stand in which the movable cymbal can be held firmly yet a delicate pedal operation becomes possible.

Another object is to provide such a stand using the principle of the lever to operate the high hat stand.

In addition, this invention has as its object the provisions of a high hat stand, in which straight or axial motion of the cymbal operating rod is provided while the smooth movement of the rod and the smooth operation of the cymbal are assured.

In the invention, the cymbal operating rod is moved up and down through movement of the foot pedal. The rod and the pedal are connected through respective rotary members which are mounted on a common rotary shaft. The distance (Y) from the rotary axis of the shaft to the cymbal operating rod connecting point is set smaller than the distance (X) from the rotary axis of the shaft to the foot pedal connecting point.

This can be accomplished according to the invention by having the two rotary members of appropriately different radii, that is each rotary member having its connection point at a different distance from the rotary axis. One or both of the rotary members may comprise a pivotable lever arm which is attached at one end to swing around the rotary member axis and is flexibly connected, through connection means, from a connection point at the other swinging end of the lever to the operating rod of the movable cymbal or to the swingable end of the foot pedal. Alternately, one or both of the rotary members may comprise a wheel or a sprocket of a radius from the rotary axis to a connection point out from the axis, e.g. on its periphery, of the desired lever arm length. A flexible connecting means, like a chain, partially wraps around the wheel and runs off the wheel tangentially to the respective one of the operating rod of the movable cymbal or the swingable end of the foot pedal. The wheel serving as a rotary member has a benefit that the connection point is typically always at a constant angular position around the wheel, which is the point at which the connecting means meets the wheel tangentially.

Furthermore, where the rotary member that is connected to the operating rod is a lever whose end swings, in order to reduce the stress upon the operating rod due to the swinging of its flexible connection to the lever, the common rotary shaft or axis is held by the swinging end of a staggering or swinging arm which swings the common rotary shaft as the rotary member lever pivots to compensate for the lateral force applied to the operating rod.

Other objects and features of the present invention will become apparent from the following description of the preferred embodiments of the invention considered in conjunction with the accompanying drawings.

DESCRIPTION OF THE PREFERRED EMBODIMENTS

Figure 1:
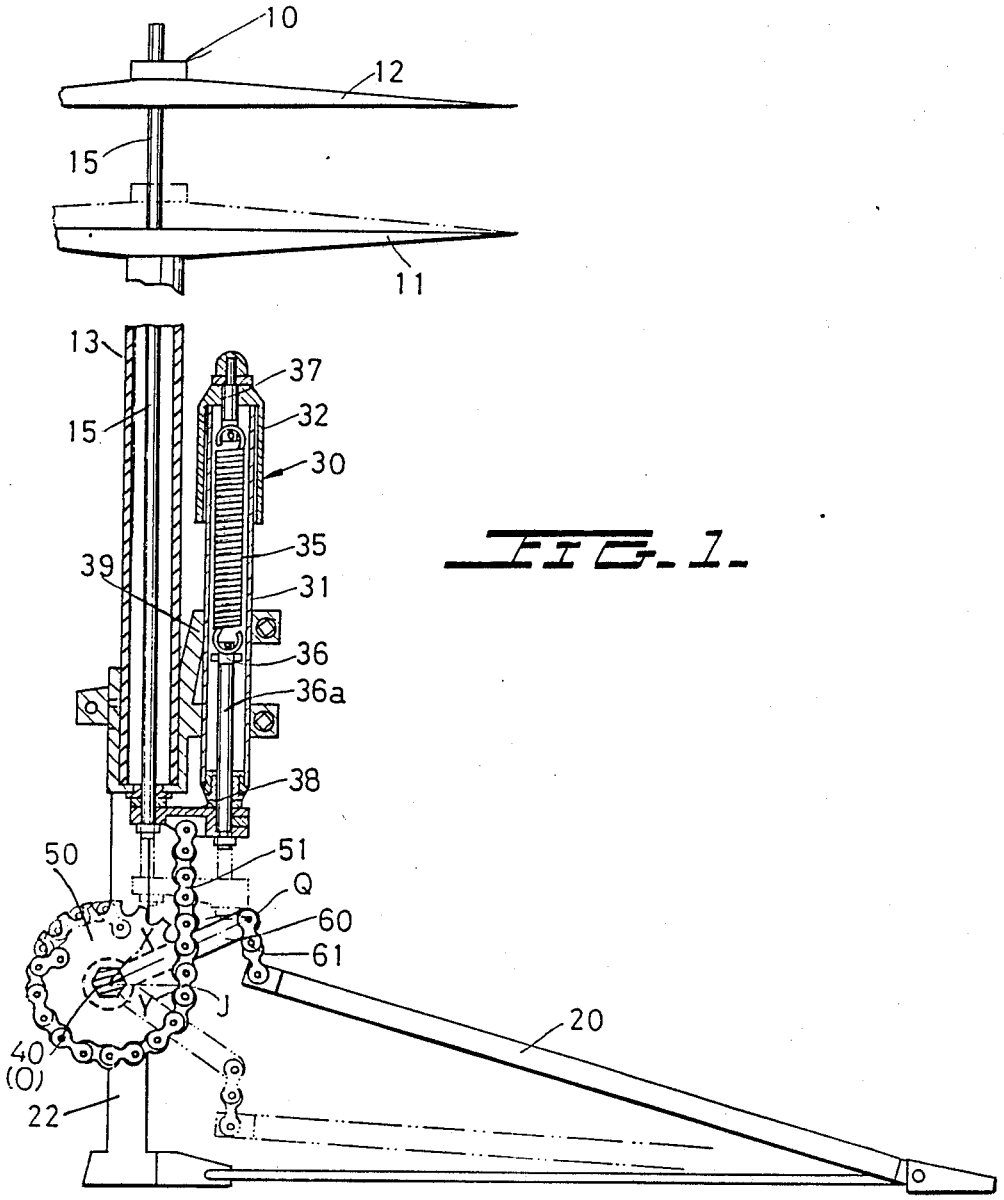
FIG. 1 is a vertical cross-section through one embodiment of a high hat stand of the present invention.

The structure of a high hat stand is explained with respect to the first embodiment of FIG. 1. At the top of the high hat stand 10, there is a lower, upwardly facing, fixed cymbal 11 and an upper, downwardly facing, movable cymbal 12. The lower fixed cymbal 11 is fixed to the main pipe body 13 of the stand. The upper movable cymbal 12 is supported on a vertically movable cymbal operating rod 15 which passes through the main pipe body 13. The vertical movement of the operating rod 15 causes the upper cymbal to engage or separate from the lower fixed cymbal 11.

The operating rod 15 of the upper movable cymbal 12 is given an upward, cymbal separating bias at all times by a spring device 30. The spring device 30 includes a main tubular body 31. An adjusting cap 32 is screwed to the top of the body 31. A coil spring 35 is held in a freely expandable and adjustable manner between the lower spring receiving member 36 on the lower portion of the main tubular body 31 and the upper spring receiving member 37 on the adjusting cap 32.

A bracket 39 supports the body of the spring device 30 on the main pipe body 13 of the stand. The rod part 36*a* below the lower spring receiving member 36 is connected with the movable cymbal operating rod 15 through a laterally extending connecting member 38, which affords the operating rod 15 with a continuous upward bias. In an alternate arrangement, not shown, the spring may be directly wound on the operating rod 15 inside the main pipe body 13.

In the invention, the cymbal operating rod 15 and the foot pedal 20 are connected through two rotary members which share and define a common unit with a common rotary shaft on a rotary axis for enabling operation of the cymbal operating rod 15 by the foot pedal 20. In the respective rotary members, the distance from the rotary axis or the rotary shaft to a first connecting point, on the periphery of the wheel 50 in FIG. 1, which receives a first connecting member 51 for the operating rod 15, is set smaller than the distance from the rotary shaft to a second connecting point, at the end of the lever 60 in FIG. 1, which receives a connecting member 61 for the foot pedal. In particular, the cymbal operating rod 15 is connected through the smaller diameter wheel 50, connecting member chain 51 and through operating rod connecting member 38 to rod 15. The chain 51 for operating the cymbal operating rod 15 is a link chain wound on the toothed wheel 50 which may be a sprocket or a partial sprocket. The first connecting point on the wheel is at a particular angular location around the wheel 50, at about the 90° position in FIG. 1, and that point remains in that angular location as the wheel 50 rotates. This is the first connecting point. The chain 51 is tangent to the wheel 50 there.

The swingable end of the vertically pivotable foot pedal 20 is connected at the second connecting point on the outer swingable end of a longer lever 60 through a flexible connecting member such as a length of link chain 61.

The wheel 50 and the long lever 60 have a common rotary shaft 40, and all together operate as a single body, having the rotary shaft 40 as the axis or fulcrum O of rotation. The rotary shaft 40 is pivotally supported on the front frame 22 of the pedal stand.

The distance or lever arm (Y) from the rotary shaft 40 of the small diameter wheel 50 to the first connecting point for the cymbal operating rod connecting means, i.e. the chain 51, is equal to the distance between the shaft 40 and the point on the periphery of the wheel 50 where the chain 51 separates tangentially and is a radius of the wheel 50. The distance or length (Y) is shorter than the distance or length (X) from the rotary shaft 40 of the long lever 60 to the second connecting point at the free end of the lever 60 for the foot pedal connecting means 61. These lever arms are important during operation, as described below. The first connecting point for the cymbal operating rod on the small wheel 50 is equivalent to the force point or fulcrum J. In the case of the long lever 60, the second connecting point for the foot pedal is likewise equivalent to the force point Q. The magnitudes of the applied forces on the operating rod and on the pedal vary according to the radial spacing of the locations of these force points.

The moments of force on the operating rod and the pedal have a relationship between the force applied and the lever length or distance. For example, it is easier to use a device in which when the distance (X) from the rotary shaft (O) to the second foot pedal connecting point (Q) is 1, then the distance (Y) from the rotary shaft (O) to the first cymbal operating rod connecting point J is substantially in a range between 0.5 and 0.7. This increases the force to the rod 15, as compared to that applied to the pedal 20 at (Q), and this reduces the travel distance of the rod 15 for the corresponding distance traveled by point (Q).

Figure 2:
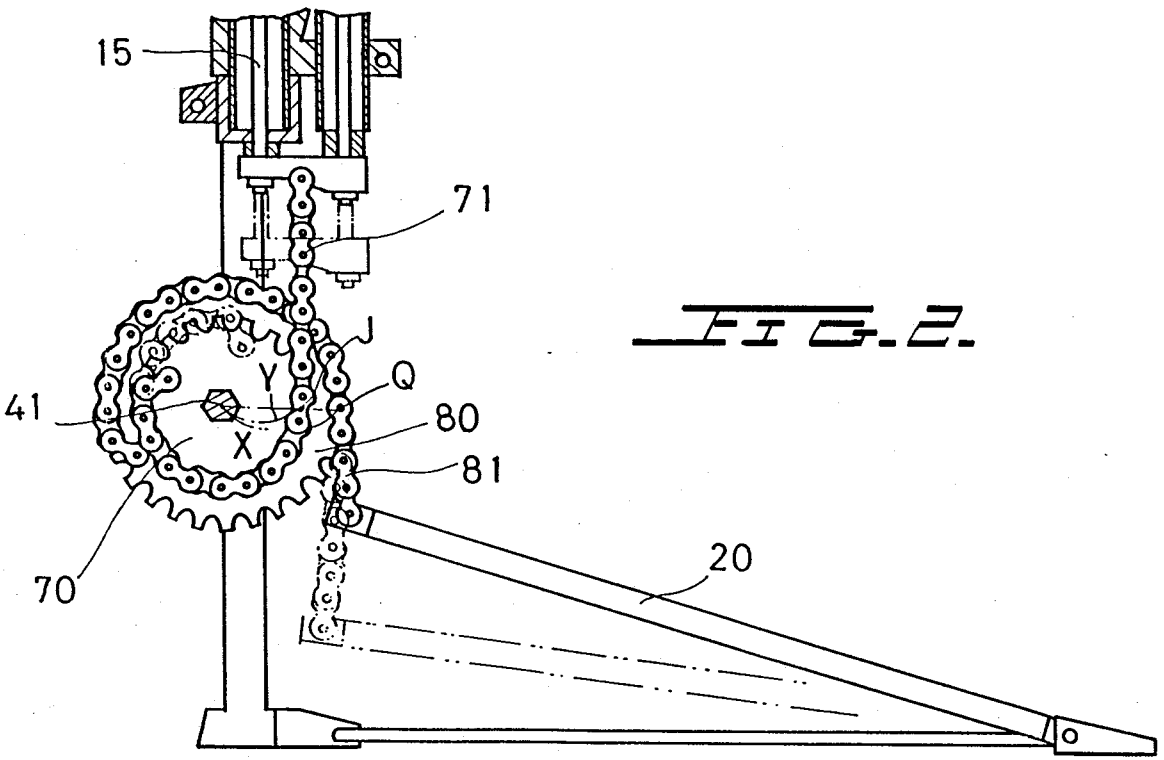
FIG. 2 is a cross section through a part of a second embodiment of the high hat stand.

FIG. 2 shows another embodiment in which one rotary member comprises a small diameter wheel 70 on the shaft 41 which is connected with the cymbal operating rod 15 and the other rotary member comprises a large diameter wheel 80 on the shaft 40 which is connected with the foot pedal. Here, too, the small diameter wheel 70 and the large diameter wheel 80 which are fixed on the shaft 41 operate as a single unit having the common rotary axis 41 or 0 of rotation. The small diameter wheel 70 carries a chain 71 for operating the movable cymbal operating rod 15, and the large diameter wheel 80 carries a chain 81 for connecting to the free end of the foot pedal 20. In FIG. 2, reference numbers J, Q, X and Y indicate the operating rod connecting point, the foot pedal connecting point, the distance from the rotary shaft to the operating rod connecting point (O-Q) and the distance from the rotary shaft to the foot pedal connecting point (O-J), respectively. In effect, the lever 60 of FIG. 1 is structurally and functionally replaced by the wheel 80 while the wheel 70 acts like the wheel 50 in FIG. 1.

Figure 3:
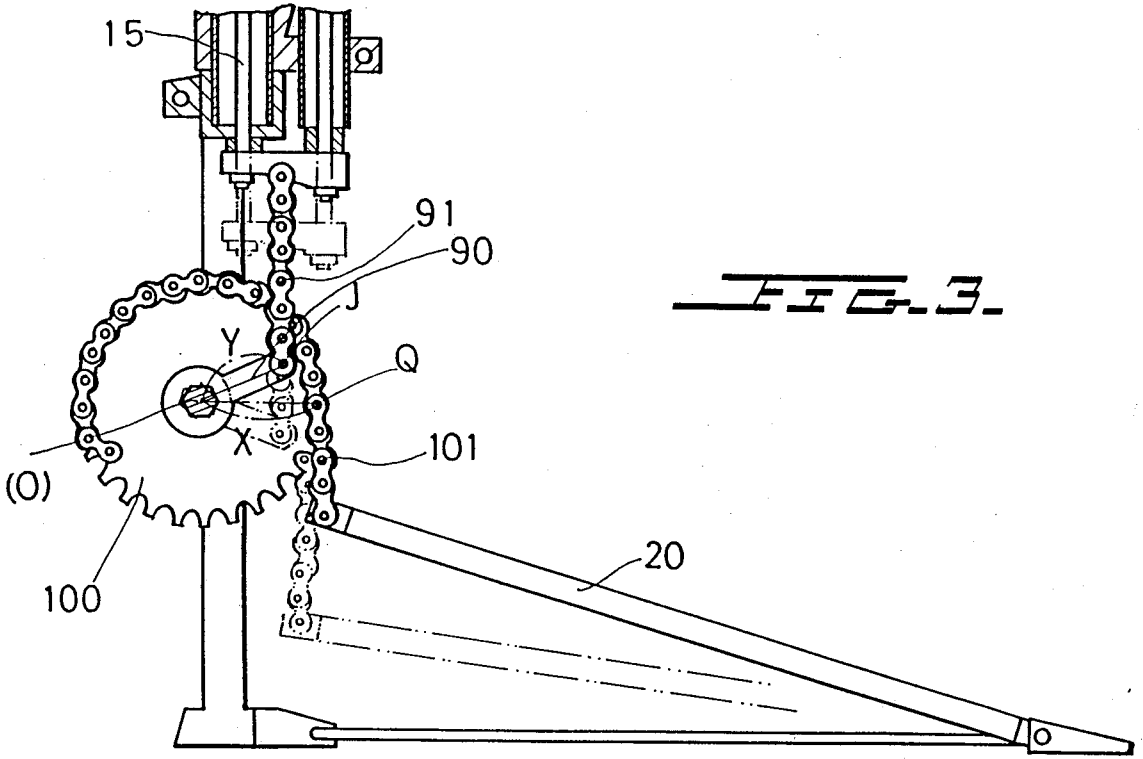
FIG. 3 is a cross section view through essentially the same structure of a third embodiment of the high hat stand.

FIG. 3 shows a third embodiment, where a short length lever 90 is used as a rotary member for driving the cymbal operating rod 15, and a large diameter wheel 100 is used as a rotary member for being operating by the foot pedal. Here too, the lever 90 and the wheel 100 which are fixed on the common rotary shaft 42 operate as a single body having the fulcrum 0 of rotation. A chain 91 connects the short lever 90 and the cymbal operating rod 15. Connecting chain 101 from the foot pedal 20 is wound on the wheel 100. The chains 91 and 101 are attached at respective connecting points on the lever 90 and the wheel 100, as in the earlier embodiments.

Figure 4:
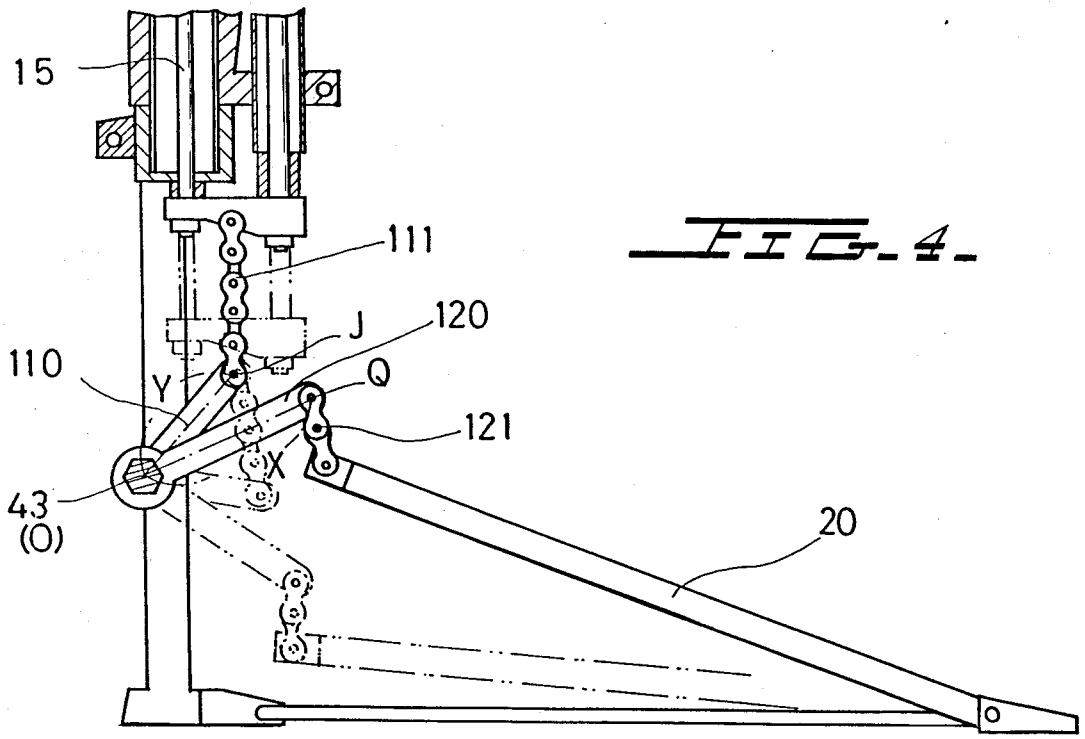
FIG. 4 is a cross section through a fourth embodiment of a high hat stand in which the lever arms to the operating rod and the pedal are shown as levers rather than radii of wheels, but in which the operating principle is the same.

FIG. 4 illustrates a fourth embodiment, where a short lever 110 operates the cymbal operating rod 15 while a long lever 120 is operated by the foot pedal 20, and both levers are employed as the respective rotary members. The short and long levers 110, 120 fixed on the common rotary shaft 43 operate as a single body having the fulcrum O for rotation. A chain 111 connects the short lever 110 with the cymbal operating rod 15. A chain 121 connects the long lever 120 with the foot pedal 20. The chains 111 and 121 are also attached at respective connecting points on the levers 110 and 120.

The embodiments of FIGS. 1–4 demonstrate the functional equivalency and substitutability of levers and sprocket wheels for this invention. As shown below, however, use of a lever rather than a wheel, particularly for operating the cymbal operating rod, desirably requires a swingable staggering arm to minimize lateral stress on the operating rod.

Figure 5A:
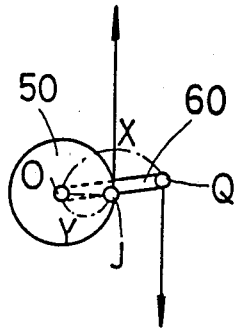
FIGS. 5A–5D shows the principles governing the action of the present invention.
Figure 5B:
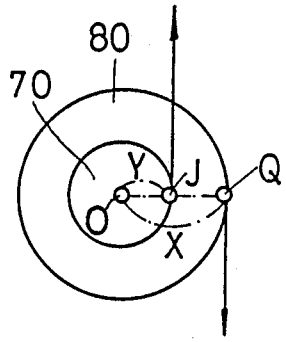
Figure 5C:
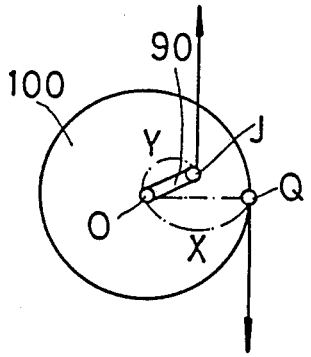
Figure 5D:
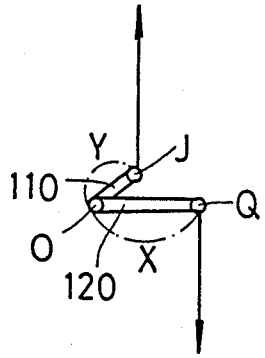

FIGS. 5A–5D show the principle that governs the action of the two rotary members in each of the first four embodiments. FIG. 5A shows the small diameter wheel 50 and the long lever 60 of FIG. 1. FIG. 5B shows the small diameter wheel 70 and the large diameter wheel 80 of FIG. 2. FIG. 5C shows the short lever 90 and the large diameter wheel 100 of FIG. 3. FIG. 5D shows the short lever 110 and the long lever 120 of FIG. 4. Each rotary member has a fulcrum or axis 0, a functional point J that sets the lever arm to the operating rod 15 and the force point (Q) that determines the lever arm to the foot pedal.

Figure 6:
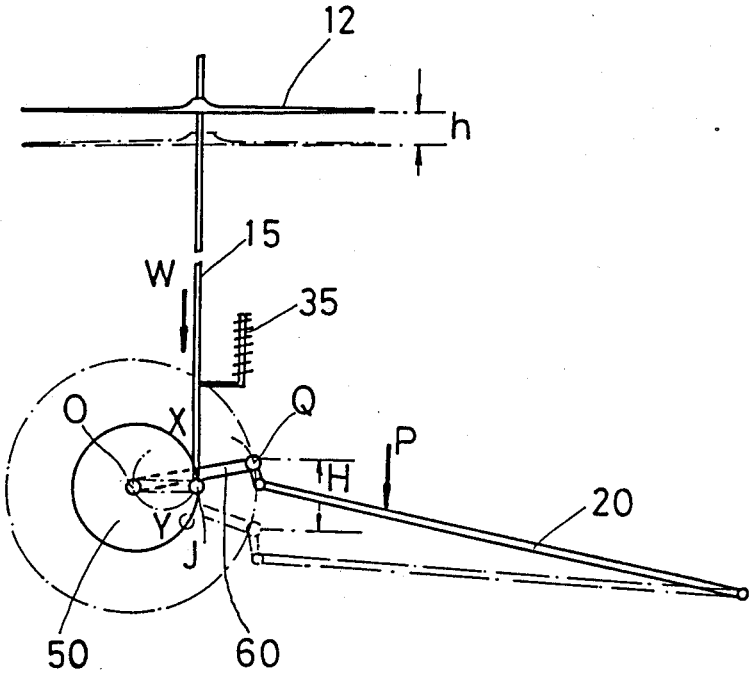
FIG. 6 is a schematic view indicating the action of a high hat stand according to the present invention.

Because a wheel and a lever may be used interchangeably as the rotary members in each embodiment, the embodiment of a small diameter wheel 50 and a long lever 60 described in FIG. 1 is discussed below and shown in FIG. 6 to show the principle governing the action of the high hat stand according to this invention. The force (W) that pulls down the cymbal 12 multiplied by the length (Y) of the arm equals the force with which the pedal is stepped on (P) multiplied by the length of the arm (X). The force that is required to pull down the cymbal (W) against the bias of the spring 35 or the force with which the pedal is stepped on (P) can be made smaller or lighter as the ratio of (Y) as compared with (X) becomes smaller or, in other words, as the functional point J approaches the fulcrum O.

On the other hand, the operating distance (H) of the pedal 20 that is required to pull down the cymbal 12 by a selected distance (H) is inversely proportional to the ratio of (Y) to (X) of the small diameter wheel 50 and the long lever 60. In other words, the stroke of the pedal will have to be increased as the functional point J comes closer to the fulcrum O.

A more detailed explanation appears in FIG. 7 for an actual high hat stand. FIGS. 7A–7D conceptually illustrate the various functions in the case where the (X):(Y) length ratio of the rotary members is set at 1:0.5 units of length measurement. The comparison between this example and a conventional high hat stand is shown as Table 1 below.

TABLE 1

| | a Conventional Product | b Invention A having the same spring pressure as in the conventional product | c Invention B having a greater spring pressure than the conventional product (1.5 times) |
|---|---|---|---|
| Set pressure of the spring | F | F | 3/2 F |
| Fore required for the pedal | F | ½F (light) | ¾F (light) |
| Pressing force of the cymbal (at the time when the leg force is expressed by P) | P–F | minus 2 P–F (closes tightly) | minus 2 P–3/2 F (closes tightly) |
| Operating Distance of the cymbal at the time when the pedal is moved by S millimeters | S | ½S (delicate action becomes possible) | ½S (delicate action becomes possible) |
| Speed with which the pedal is restored | V | 2 V (fast) | = 2 V (1 + α) Approximately equal to 2V (one plus (alpha) (faster by the stronger portion (alpha) of the spring)) |

Figure 7A:
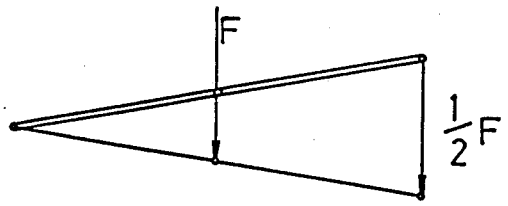
FIGS. 7A–7D are schematic or diagrammatic views showing the various functions of the present invention.

In FIG. 7A, if the spring pressure that is applied to the cymbal operating rod 15 is expressed by F, the force that is required for stepping on the pedal can be one-half F. This shows that the pedal of the invention can be stepped on with a smaller force than the pedal in a conventional product, provided that the spring pressure remains the same (in the case of Invention A in Table 1). As a result, an operating rod return spring having a greater spring force than in the past can be employed. In Invention B in Table 1, the pedal can be stepped on with a smaller force (¾) than in the conventional high hat stand, even when a spring whose spring pressure is 1.5 times as large as for a spring in the conventional stand is used.

Figure 7B:
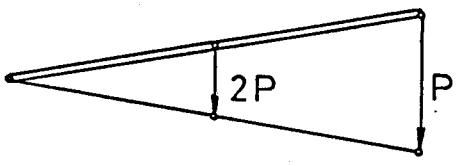

FIG. 7B shows that a force of 2P is applied to the movable cymbal at the time when the pedal is stepped on with a force of P, when the movable cymbal contacts the fixed cymbal and they are in a closed state. Actually, the cymbals are pressed with a force of 2P, minus pressure F of the spring. Tight closing of the cymbals can be achieved, as compared with the conventional force of P minus F, thereby making it possible to realize tight closing for better performance.

Figure 7C:
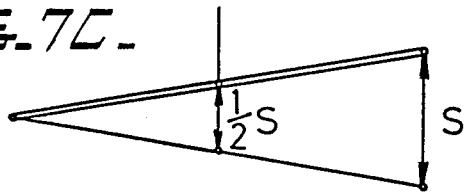

FIG. 7C indicates that the cymbal moves by a distance of one-half S millimeters or mm when the pedal is moved by a distance of S mm. On the principle of a lever, the distance becomes twice as great when the force become one half as large.

The above explanation shows that the pedal operation can be carried out "light and easy," and the invention is highly useful for the fine performing technique of delicate opening or closing while the cymbal is kept in a closed state.

Figure 7D:
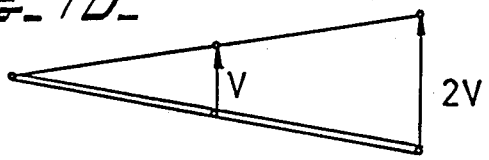

FIG. 7D shows that the pedal is restored at the speed 2V when the cymbal operating rod is restored at the speed V. This restoration causes the plate of the pedal to seem to the performer to stick to the sole of his foot. It gives a pleasant feeling to the performer and improves the performing technique.

Figure 8:
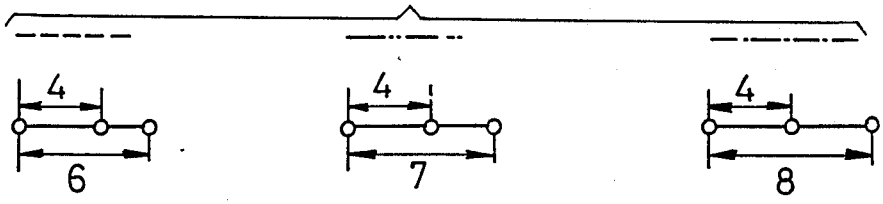
FIG. 8 depicts the condition graphed in FIGS. 8A and 8B.
Figure 8A:
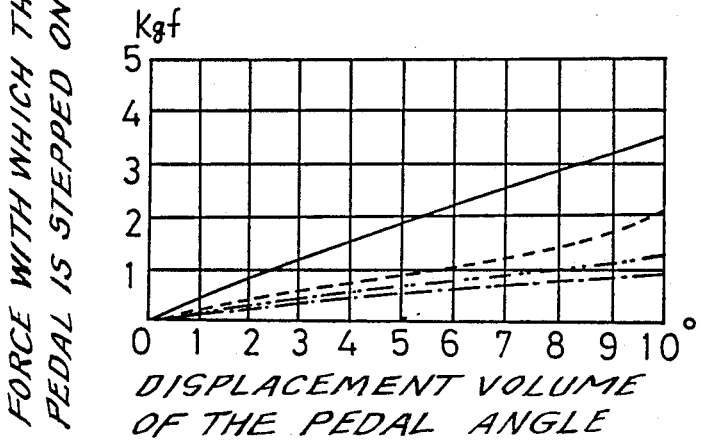
FIGS. 8A and 8B show comparisons between an example of the invention and a conventional high hat stand.
Figure 8B:
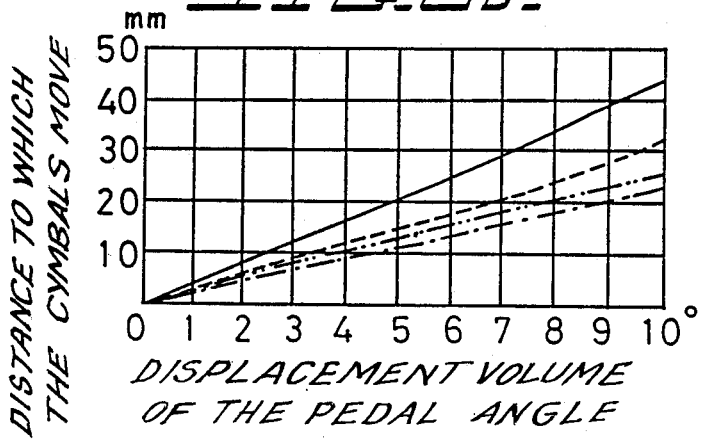

FIG. 8 graphs measurements made on an actual high hat stand and shows the relationship between the pedal stroke and the stepping force FIG. 8A and the relationship between the pedal stroke and the distance which the cymbal moves in FIG. 8B, in the case where the operating rod connecting point (J) was changed in the rotary member.

As shown, the broken line indicates the case where X:Y is 6:4 (the length Y is 0.67 when the length X is 1); the two-dot chain indicates the case where X:Y is 7:4 (the length Y is 0.57 when the length X is 1); and the one-dot chain indicates the case where X:Y is 8:4 (the length Y is 0.5 when the length X is 1). The solid line indicates the conventional product in which the operating rod and the pedal are directly connected.

The high hat stand of this first embodiment in which a lever is employed for the connection between the pedal and the cymbal operating rod, has superior effects stemming from its reliance upon levers.

As it is possible to step on the pedal with a smaller force, it is possible to drastically change the conventional pedal stepping feeling to the performer, with the operability being greatly improved. If deemed necessary, it is also possible to employ a return spring which is stronger than the return springs used in the past, thereby increasing the range from which the springs to be used can be selected.

Since it is also possible to hold the cymbal with a stronger force, it is possible to realize a tight closing at the time when the cymbals are brought together, thereby making it possible to offer a clear and sharp performance.

Because the operating distance of the pedal becomes large as compared with the operating distance of the cymbal operating rod, it becomes further possible to effect delicate movements, and it is thereby possible to carry out repetitive operations of cymbal opening and closing in a simple manner.

Moreover, the restoration of the pedal becomes faster and the pedal gives such a feeling to the performer that it seems to stick to the sole of his foot thereby affording the performer a pleasant feeling and, at the same time, improving his performing technique.

Figure 9A:
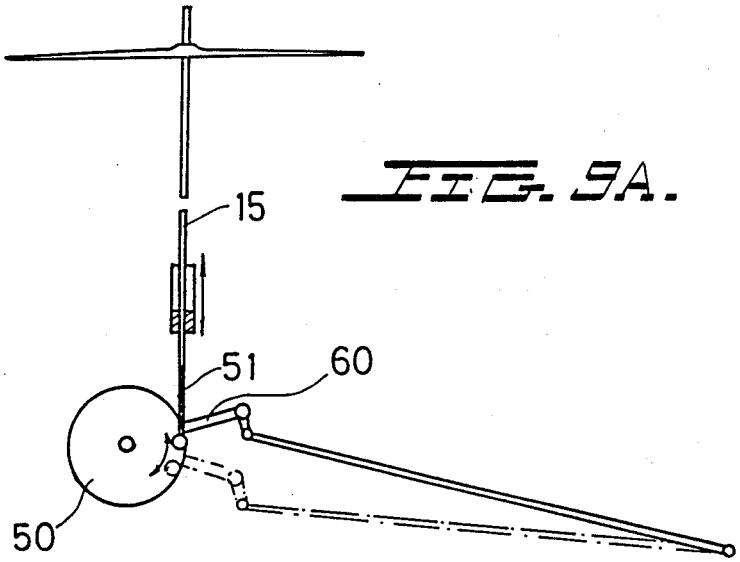
FIGS. 9A–9B are schematic views showing the action of the cymbal operating rod in accordance with the present invention.
Figure 9B:
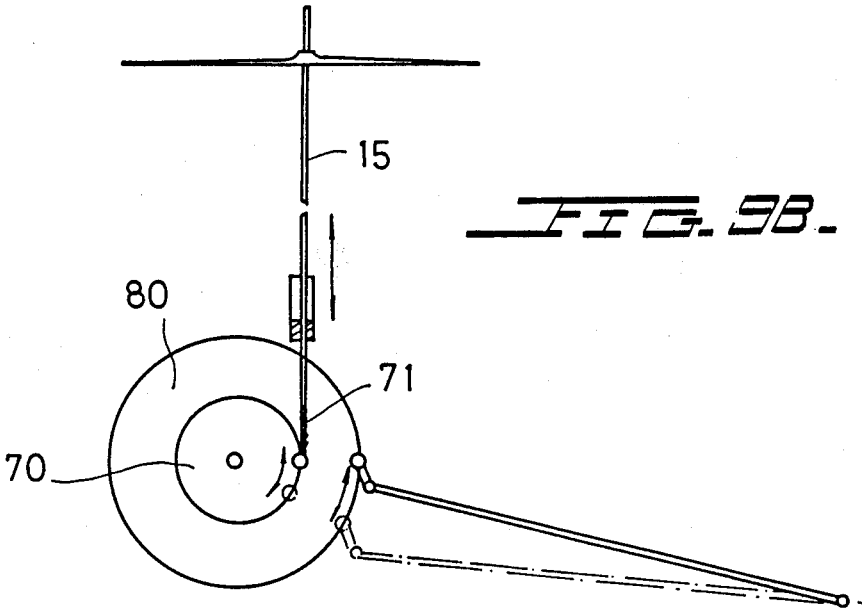

In the stands shown in FIGS. 1 and 2 where the small diameter wheels 50 and 70 are the rotary members for the cymbal operating rod 15, that rod 15 moves straight along its vertical axial line, assuring smooth movement of the rod, provided that the connecting part of the chain 51 or 71 that connects the cymbal operating rod 15 and the respective small diameter wheel 50 or 70 comes tangentially off the wheel along the axial line of the cymbal operating rod 15, as shown in the various schematic showings contained in FIG. 9.

In the stands shown in FIGS. 3 and 4, where the rotary member for the cymbal operating rod 15 is the short lever 90 or 110, rather than a constant radius wheel, the cymbal operating rod connecting part J moves in an arc with the rotary shaft 0 of the rotary member as the center. This produces deviations of the connecting chain, which extends between the lever and the rod, away from the axis of the operating rod 15 as the cymbal operating rod moves up and down. The rod 15 may be tilted by those deviations and frictional resistance is caused by the pipe sliding part, thereby causing a feeling of heaviness in operation.

An arrangement is needed to produce smooth straightforward motion of the cymbal operating rod with a lever, just like that experienced with a wheel rotary member. This is accomplished by absorbing the socalled deviations of the connection to the operating rod by appropriately shifting or swinging the position of the rotary axis of the rotary member by means of a swinging or staggering arm.

Figure 10:
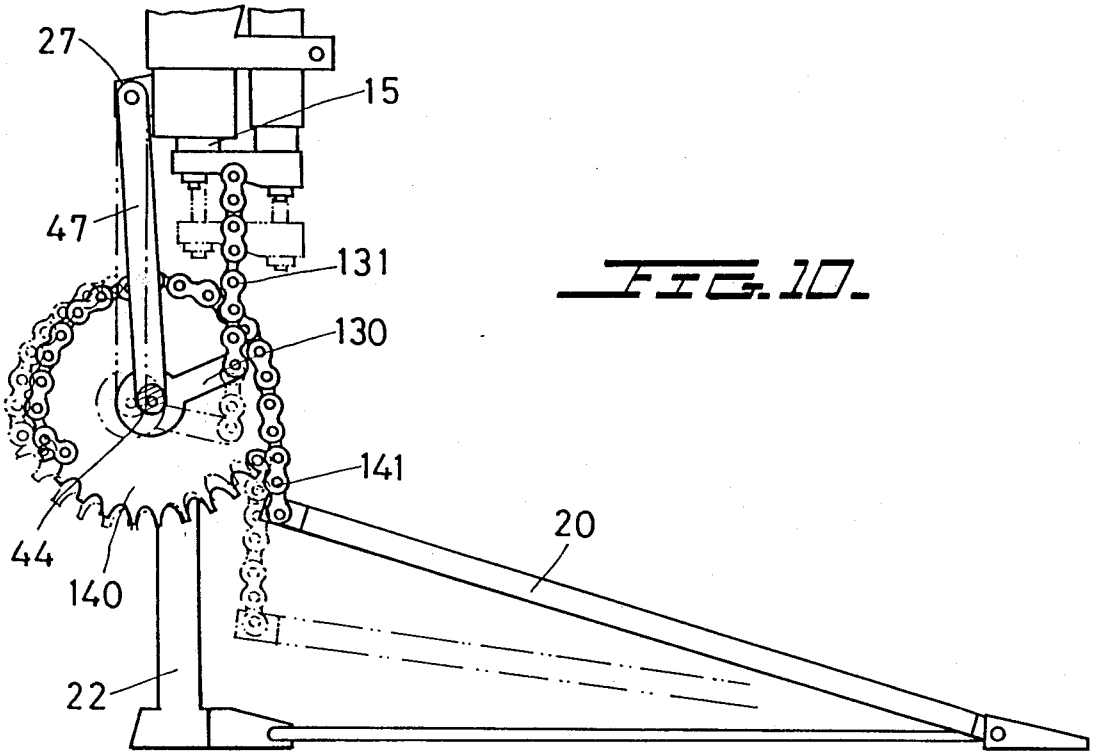
FIG. 10 is a cross section through a fifth embodiment of a high hat stand.
Figure 11:
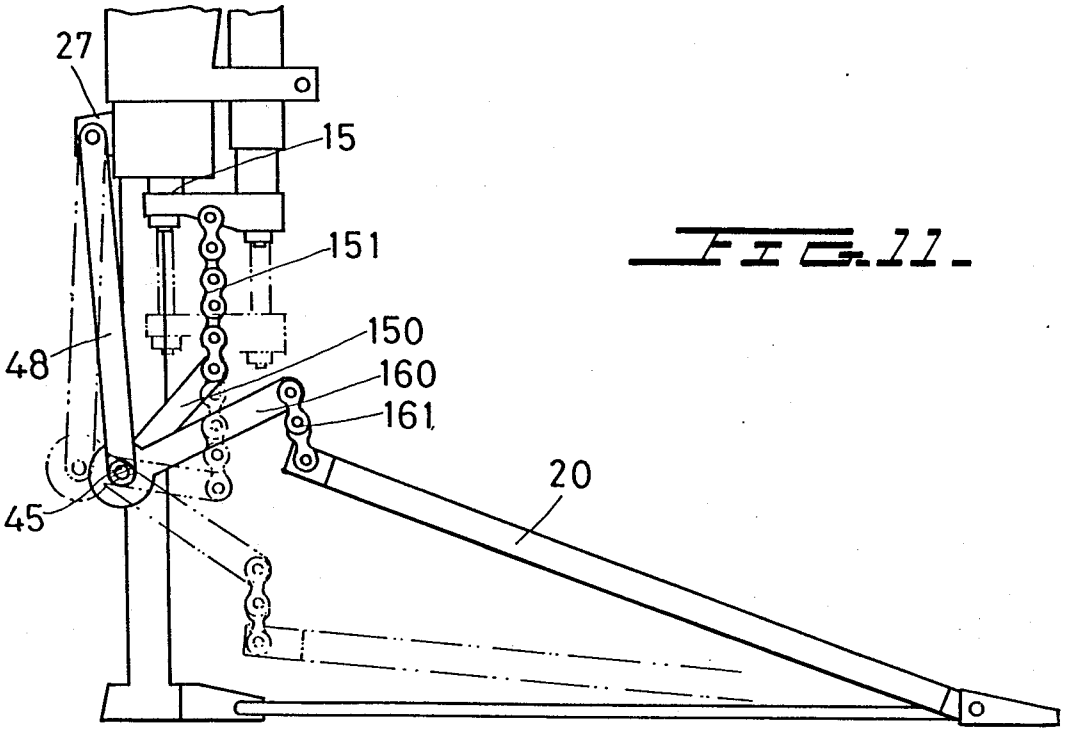
FIG. 11 is a cross-section through a sixth embodiment of the present invention.

The high hat stands shown in FIGS. 10 and 11 are respective modified embodiments of the high hat stands shown in FIGS. 3 and 4, including respective swinging or staggering arms 47 and 48

In FIG. 10, the short lever 130 for the cymbal operating rod 15 and the large diameter wheel 140 for the foot pedal 20 have a common rotary axis 44 and operate as a single body, as in FIG. 3.

A chain 131 connects the end of the short lever 130 (smaller rotary member) with the bottom of the cymbal operating rod 15. A chain 141 for the foot pedal 20 is wound on the large diameter wheel 140. A staggering arm 47 is pivotally journaled at the upper protrusion of the pedal stand 22. The common rotary axis 44 is held at the swingable bottom tip of the staggering arm 47.

In FIG. 11, the short lever 150 for the cymbal operating rod 15 and the long lever 160 for the foot pedal 20 on the common rotary axis 45 act as a single body. A chain 151 connects the short lever 150 and the cymbal operating rod 15. A chain 161 connects the long lever 160 and the foot pedal 20. As in FIG. 11, a staggering arm 48 is pivotally journaled at the upper protrusion 27 of the pedal stand 22, and the rotary axis 45 is held at the swingable bottom tip of the staggering arm 48.

Figure 12A:
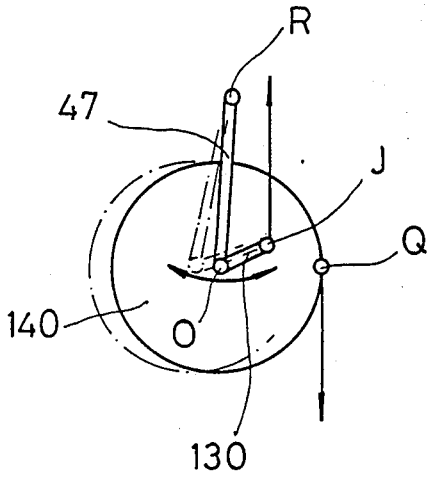
FIGS. 12A and 12B are schematic views explaining the principles governing the action of the rotary members in FIGS. 10 and 11.
Figure 12B:
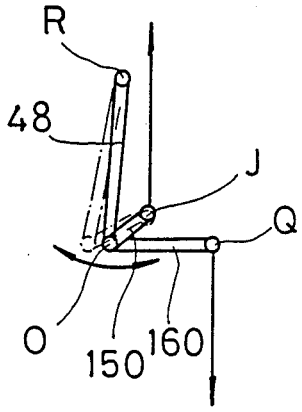
Figure 14:
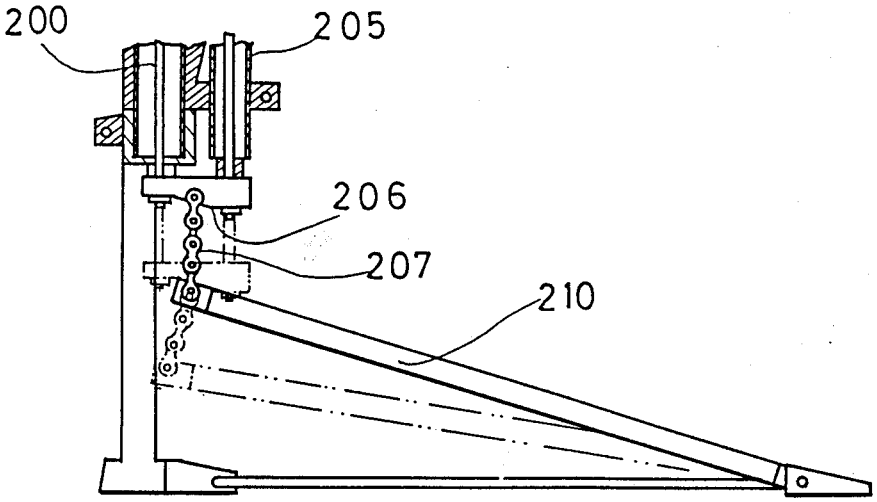
FIG. 14. PRIOR ART
FIG. 14 is a schematic cross sectional view through a prior art high hat stand.

FIGS. 12A and 12B show the principle governing the action of these rotary members. FIG. 12A shows the short lever 130 and a large diameter wheel 140 of FIG. 10. FIG. 12B shows the short lever 150 and the long lever 160 of FIG. 11.

Both of the rotary members 44, 45 have a rotary fulcrum O, functional point J and a force point Q and both move based upon the principle of the lever. At the same time, the rotary member itself swings in an arc with the staggering arms 47 and 48 as the fulcrum R.

Figure 13A:
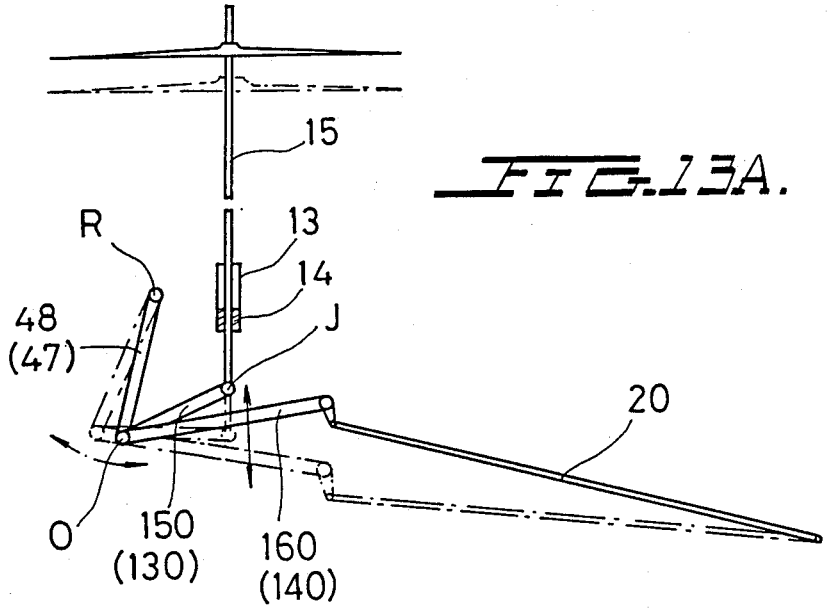
FIGS. 13A and 13B are schematic views indicating again the principle of operation of FIGS. 10 and 11.
Figure 13B:
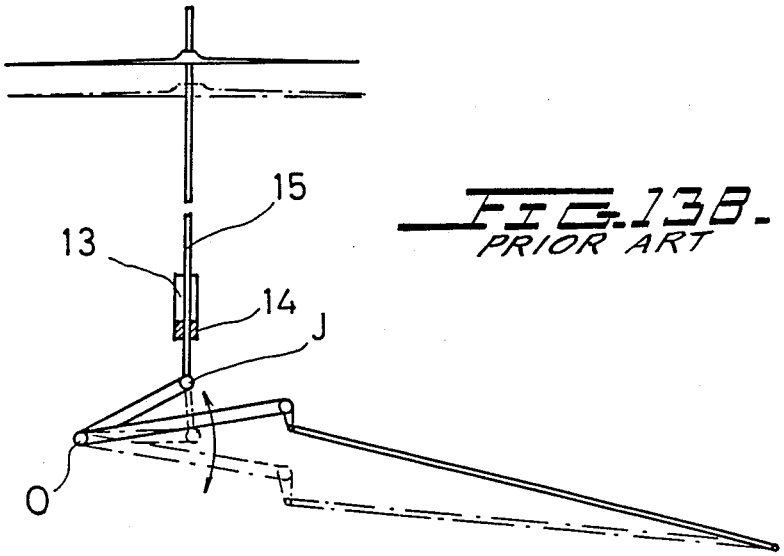
FIG. 13B. PRIOR ART

The operation of this high hat cymbal is explained in FIGS. 13A and 13B. In FIG. 13A, the up-and-down movement of the foot pedal 20 primarily rotates the rotary members 150 and 160 (or 130 and 140) with the rotary shaft 0 as the center. By the rotation of the rotary members, the cymbal operating rod connection part J engages in an arc movement. At this juncture, however, a friction resistance is produced due to the sliding of the sliding part 14 of the pipe 13 in the cymbal operating rod 15.

The above friction resistance produces lateral motion of the rotary members as a whole due to the staggering arm 47 or 48. As a consequence, the friction resistance is absorbed and, at the same time, smooth straightforward motion of the cymbal operating rod 15 is secured.

FIG. 13B shows an example in which there is no staggering arm, for the purpose of comparison. As has already been described, the cymbal operating rod connecting part J engages in an arcuate movement, with the rotary axis O of the rotary member as the center. The rod 15 is tilted when the rod 15 moves up and down. This produces frictional resistance vis-a-vis the pipe sliding part 14, thereby making the operation heavy.

The high hat stand with a lever connection to the cymbal operating rod, rather than a wheel or sprocket connection, offers a high hat stand having superior operability, while enjoying all of the advantages and features of the wheel connection type stand described earlier.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A high hat stand for cymbals comprising a support for a stationary cymbal and a stationary cymbal carried on the support;

a movable cymbal and an operating rod on which the movable cymbal is supported, the operating rod being movable for moving the movable cymbal in a first, contacting direction to move the movable cymbal into engagement with the stationary cymbal and in a second, out of contact direction for moving the movable cymbal out of engagement with the stationary cymbal;

a foot pedal operable in one direction for moving the operating rod to move the movable cymbal in the first, contacting direction, and the pedal being movable in the opposite direction for permitting movement of the operating rod in the second, out of contact direction;

a rotary shaft having an axis that extends across the direction of movement of the operating rod in the first, contacting and second, out of contact directions;

a first rotary member on the shaft, a first connecting point on the first rotary member and spaced a first distance from the axis of the rotary shaft, first means connecting the first connecting point on the first rotary member to the operating rod, such that the operating rod is acted upon by a force produced by a lever arm of the length from the axis of the rotary shaft to the first connecting point;

a second rotary member on the shaft, a second connecting point on the second rotary member and spaced a second distance from the axis of the rotary shaft, second means connecting the second connecting point to the pedal, such that movement of the pedal moves the second connecting point and rotates the second rotary member around the shaft;

wherein the first effective radius of rotation between the shaft and the first connecting point is smaller than the second effective radius of rotation between the shaft and the second connecting point.

2. The high hat stand of claim 1, further comprising biasing means normally urging the operating rod in the second, out of contact direction, and the pedal being operable for moving the operating rod in the first contact direction against the bias of the biasing means, and reduction of force on the pedal enables the biasing means to return the operating rod in the second out of contact direction

3. The high hat stand of claim 2, wherein the biasing means is supported separated from the movable cymbal operating rod; extending means extend from the biasing means to the operating rod for transmitting the biasing force from the biasing means to the operating rod; the first connecting means extending into connection with the operating rod by being connected to the extending means between the biasing means and the operating rod.

4. The high hat stand of claim 1, wherein the first rotary member comprises a first wheel having a periphery, the first connecting point is at the periphery of the first wheel and the first connecting means extends from the first connecting point at the periphery of the first wheel to the operating rod.

5. The high hat stand of claim 4, wherein the first connecting point remain generally at a particular angular location around the first wheel as the first wheel rotates, and the first connecting point is the point at which the first connecting means tangentially contacts the first wheel.

6. The high hat stand of claim 5, wherein the first rotary member wheel comprises a sprocket and the first connecting means from the first rotary member to the operating rod comprises a chain with links complementary to the sprocket such that as the first rotary member sprocket rotates, the chain is selectively drawn onto or permitted to move off the sprocket.

7. The high hat stand of claim 4, wherein the second rotary member comprises a lever, with the lever extending between the shaft and the second connecting point.

8. The high hat stand of claim 1, wherein the first and the second rotary members are united with the shaft and rotate together with the shaft as a unit.

9. The high hat stand of claim 1, wherein the first rotary member comprises a lever extending from the shaft to the first connecting point.

10. The high hat stand of claim 9, wherein the second rotary member comprises a wheel having a periphery, the second connecting point of the second rotary member is disposed on the periphery of the wheel at a greater distance from the shaft than is the first connecting point.

11. The high hat stand of claim 10, wherein the second connecting point remains generally at a particular angular location around the second rotary member wheel as the second wheel rotates, and the second connecting point is the point at which the second connecting means tangentially contacts the second wheel.

12. The high hat stand of claim 11, wherein the second rotary member wheel comprises a sprocket and the second connecting means between the second rotary member and the pedal comprises a chain with links complementary to the sprocket, such that as the second rotary member sprocket rotates, the chain is selectively drawn onto or permitted to move off the sprocket.

13. The high hat stand of claim 9, wherein the second rotary member also comprises a second lever extending from the shaft to the second connecting point, and the second connecting point is a greater distance from the shaft than is the first connecting point of the first lever.

14. The high hat stand of claim 1, further comprising a swingable staggering arm connected to the support at a first location along the staggering arm and connected to the shaft at a second location spaced from the first location along the staggering arm for supporting the shaft for swinging along with the swingable staggering arm around the first location, such that lateral stress, which is applied to the operating rod by the first connecting means connected to the first rotary member due to the rotation of the first rotary member, may at least in part be absorbed by the swinging of the staggering arm, and the resultant swinging of the rotary shaft to a position helping to relieve the lateral stress upon the operating rod.

15. The high hat stand of claim 14, wherein the first rotary member comprises a lever extending from the shaft to the first connecting point.

16. The high hat stand of claim 15, wherein the second rotary member comprises a second lever extending from the shaft to the second connecting point and the second connecting point is a greater distance from the shaft than is the first connecting point of the first lever.

17. The high hat stand of claim 14, wherein when the distance from the rotary shaft to the second connecting point is 1 unit of distance, then the distance from the rotary shaft to the first connecting point is in the range of between 0.5 unit and 0.7 unit of distance.

18. The high hat stand of claim 1, wherein the first rotary member comprises a first wheel, and the first connecting point is on the first wheel spaced from the shaft.

19. The high hat stand of claim 18, wherein the second rotary member also comprises a second wheel, and the second connecting point on the second wheel is a greater distance from the shaft than the first connecting point on the first wheel.

20. The high hat stand of claim 1, wherein the operating rod is generally vertical and is supported for vertical motion, the rotary shaft axis is horizontal, the pedal is supported for pivoting motion vertically around the horizontal rotary shaft axis, and the part of the pedal connected with the second connecting means is spaced from the horizontal pivot axis of the pedal.

21. The high hat stand of claim 1, wherein when the distance from the rotary shaft to the second connecting point is 1 unit of distance, then the distance from the rotary shaft to the first connecting point is in the range of between 0.5 unit and 0.7 unit of distance.

* * * * *